US006536882B1

(12) United States Patent
Hawkins et al.

(10) Patent No.: US 6,536,882 B1
(45) Date of Patent: Mar. 25, 2003

(54) INKJET PRINTHEAD HAVING SUBSTRATE FEEDTHROUGHS FOR ACCOMMODATING CONDUCTORS

(75) Inventors: Gilbert A. Hawkins, Mendon, NY (US); Constantine N. Anagnostopoulos, Mendon, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/625,536

(22) Filed: Jul. 26, 2000

(51) Int. Cl.[7] ..... B41J 2/105
(52) U.S. Cl. ..... 347/77; 347/82
(58) Field of Search ..... 347/77, 74, 73, 347/54, 50

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,878,519 A | | 4/1975 | Eaton | |
| 4,346,387 A | | 8/1982 | Hertz | |
| 4,791,440 A | * | 12/1988 | Eldridge et al. | 347/50 X |
| 4,935,750 A | * | 6/1990 | Hawkins | 347/63 |
| 4,991,000 A | * | 2/1991 | Bone et al. | 257/686 |
| 5,166,097 A | | 11/1992 | Tanielian | |
| 5,399,898 A | | 3/1995 | Rostoker | |
| 5,416,872 A | | 5/1995 | Sizer, II et al. | |
| 5,424,245 A | | 6/1995 | Gurtler et al. | |
| 5,966,154 A | * | 10/1999 | DeBoer | 347/82 |

FOREIGN PATENT DOCUMENTS

| | | | | |
|---|---|---|---|---|
| EP | 0 289 347 A2 | | 2/1988 | |
| EP | 0 594 310 A2 | | 4/1994 | |
| EP | 0913 261 A2 | | 5/1999 | |
| JP | 60-13564 A | * | 1/1985 | 347/50 |
| JP | 10076669 A | | 3/1998 | |
| JP | 2000177122 A | | 6/2000 | |

* cited by examiner

*Primary Examiner*—Anh T. N. Vo
(74) *Attorney, Agent, or Firm*—Norman Rushefsky

(57) ABSTRACT

An inkjet printhead for printing an image on a printing medium is provided that includes a substrate having an interior and a nozzle face, a plurality of nozzles having outlets in the nozzle face, an electronically-operated droplet deflector disposed adjacent to each of the nozzle outlets, and feedthroughs for connecting the droplet deflector to power and image data circuits through the substrate interior. The feedthroughs include bores disposed through the substrate for accommodating conductors connected between the droplet deflectors and power and image data control circuits of the printer. The feedthroughs may take the form of bores either coated or filled with electrically-conductive material. The use of feedthroughs through the printhead substrate avoids the manufacture of an undesirably high density of connectors and conductors on the nozzle face and facilitates the manufacture of smooth and flat nozzle faces which are easily cleaned during the printing operation by wiping mechanisms. The power feedthroughs may be easily manufactured via MEMS bulk micromachining technology at the same time the substrate ink channels are formed.

7 Claims, 4 Drawing Sheets

LATCH CLOCK
DATA IN
SHIFT REGISTER
LATCH CIRCUIT
70
72
73
50
46
79
59a
52
51
53
75
59b
77
80
84
82
V+

INKJET PRINTHEAD HAVING SUBSTRATE FEEDTHROUGHS FOR ACCOMMODATING CONDUCTORS

FIELD OF THE INVENTION

This invention generally relates to inkjet printheads, and is specifically concerned with a continuous inkjet printhead having substrate feedthroughs for accommodating power, image information and fluid conductors.

BACKGROUND OF THE INVENTION

Inkjet printing has become recognized as a prominent contender in the digitally-controlled, electronic printing arena because of its non-impact, low-noise characteristics, its use of plain paper, and its avoidance of toner transfers and fixing. Inkjet printing mechanisms can be categorized as either continuous inkjet or drop-on-demand inkjet.

Continuous inkjet printing mechanisms comprise a substrate having an array of nozzles, each of which communicates with a supply of ink under pressure. The substrate has a side or face that confronts the printing medium, and which includes the outlets of each of the various nozzles. Each of the nozzle outlets continuously discharges a thin stream of ink which breaks up into a train of ink droplets a short distance from the printhead. Such printheads further include a droplet deflector for selectively deflecting droplets toward a printing medium and away from a gutter, which captures and recycles the droplets through the pressurized ink supply.

Conventional droplet deflectors impart an electrostatic charge on selected droplets which allows them to be deflected, via a repulsive charge, into the printing medium. More recently, the Eastman Kodak Company has developed thermal droplet deflectors that include an annular or semi-annular heating element circumscribing the nozzle outlets. In operation, these heating elements selectively apply asymmetric heat pulses to the stream of ink flowing out of the nozzles. These heat pulses alter the surface tension of one side of the stream of ink ejected from the nozzle outlet, thereby causing the droplet forming stream to momentarily deflect toward the printing medium. Alternatively, the printhead may be arranged so that undeflected droplets strike the printing medium, while droplets deflected by the heat pulses strike the ink gutter. The use of such heaters (which may be conveniently integrated into a silicon printhead substrate via CMOS technology) represents a major advance in the art, as far simpler to construct than conventional droplet deflectors utilizing delicate arrangements of electrostatic charging plates.

As advantageous as thermally-operated droplet deflectors are, the inventors have noted several areas where the performance of such devices might be improved. In particular, the inventors have observed that in a typical 600 nozzle per inch printhead, nearly 160 conductors are needed per inch to connect the heaters on the nozzle face to power, and the nozzles to a source of ink. While the most direct manner of installing such conductors would be to mount them directly over the nozzle face of the printhead substrate, such an installation is difficult to implement in practice due to the large number of connections and conductors and the limited area available on the nozzle face.

SUMMARY OF THE INVENTION

Generally speaking, the invention is an inkjet printhead that comprises a substrate having an interior and a flat nozzle face, at least one nozzle having an outlet in the nozzle face, an electronically-operated droplet deflector disposed adjacent to the nozzle outlet, and a plurality of feedthroughs disposed through the substrate interior for connecting the droplet deflector to power. Other feedthroughs or channels conduct pressurized liquid ink to the nozzles. The feedthroughs may include passageways disposed through the substrate interior for accommodating power and information carrying conductors connected between the droplet deflector and the power and image data circuits. The passageways may be in the form of bores extending through the interior of the substrate, and the electrical power and information carrying conductors may be either metal coatings around the surface of the bores, or metal fillings which pack the interior of the bores.

The electronically-operated droplet deflector may include a plurality of heaters circumscribing the nozzle outlets, and control circuit. Both the heaters and control circuit may be integrated into the substrate below the surface of the nozzle face via CMOS technology. The electrical conductors may be integrated in the substrate and terminate below the surface of the nozzle face. The heater control circuit applies pulses of electrical power to the heaters, which in turn generates asymmetric heat pules. The asymmetric heat pulses generate synchronous droplets and at the same time steer them toward a printing medium. In the case of symmetric heating, applied to the jet or no heat at all, the fluid is directed towards a gutter for recycling.

The use of feedthroughs throughout the interior of the printhead substrate in lieu of connections on the nozzle face of the substrate obviate the need for high, difficult-to-manufacture connector densities, and avoids unwanted surface irregularities in the nozzle face of the substrate so that it may be easily and safely cleaned by conventional wiping techniques.

BRIEF DESCRIPTION OF THE DRAWINGS

In the Detailed Description of the Invention presented below, reference is made to the accompanying drawings in which.

DETAILED DESCRIPTION OF THE INVENTION

The invention is particularly applicable to a printer system that uses an asymmetric application of heat around a continuously operating inkjet nozzle to achieve a desired ink droplet deflection. In order for the invention to be concretely understood, a description of the inkjet printer system 1 that the invention applies to will first be given.

Figure 1:
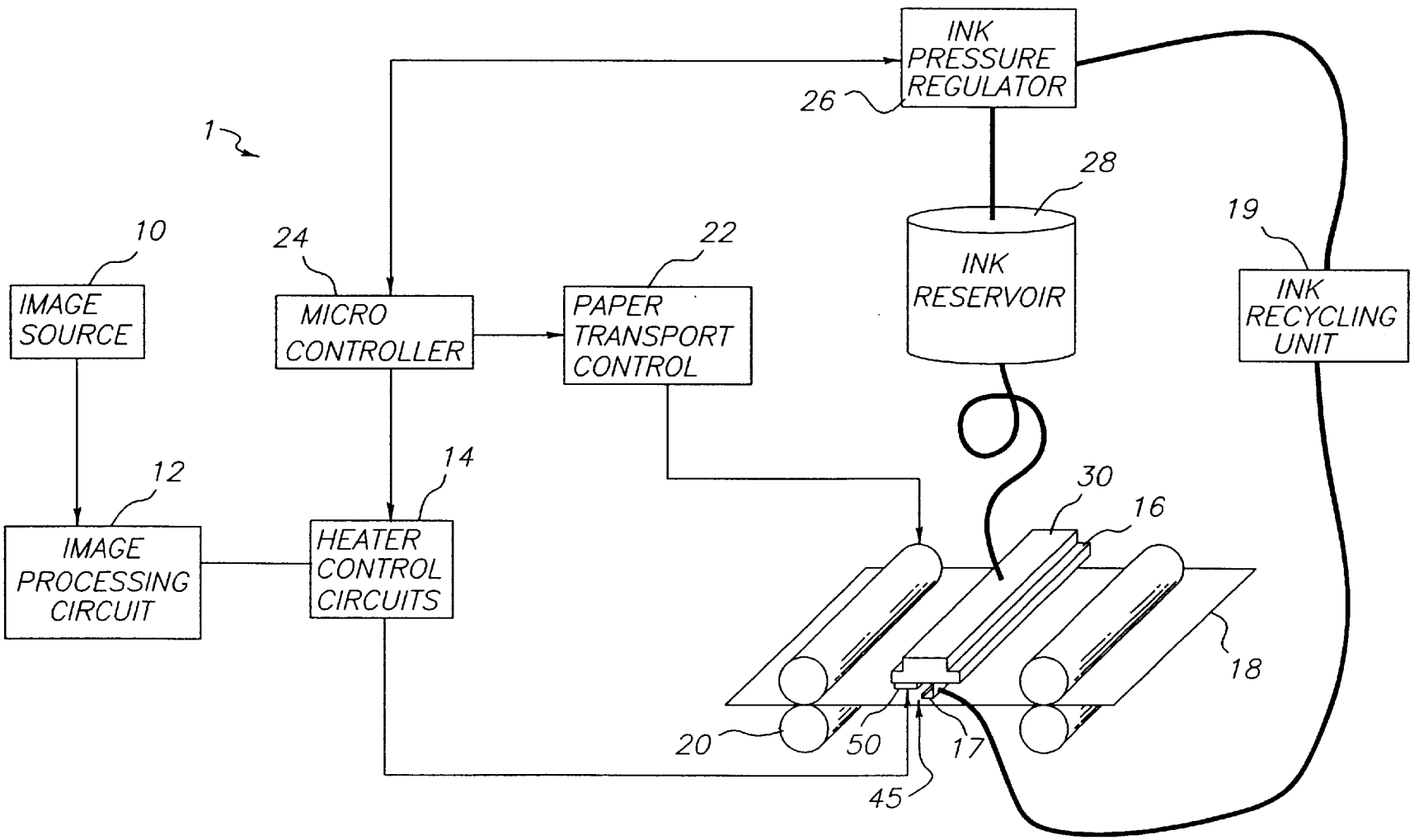
FIG. 1 is a simplified block schematic diagram of one exemplary printing apparatus to which the present invention applies.
Figures 2, 2A, 2B:
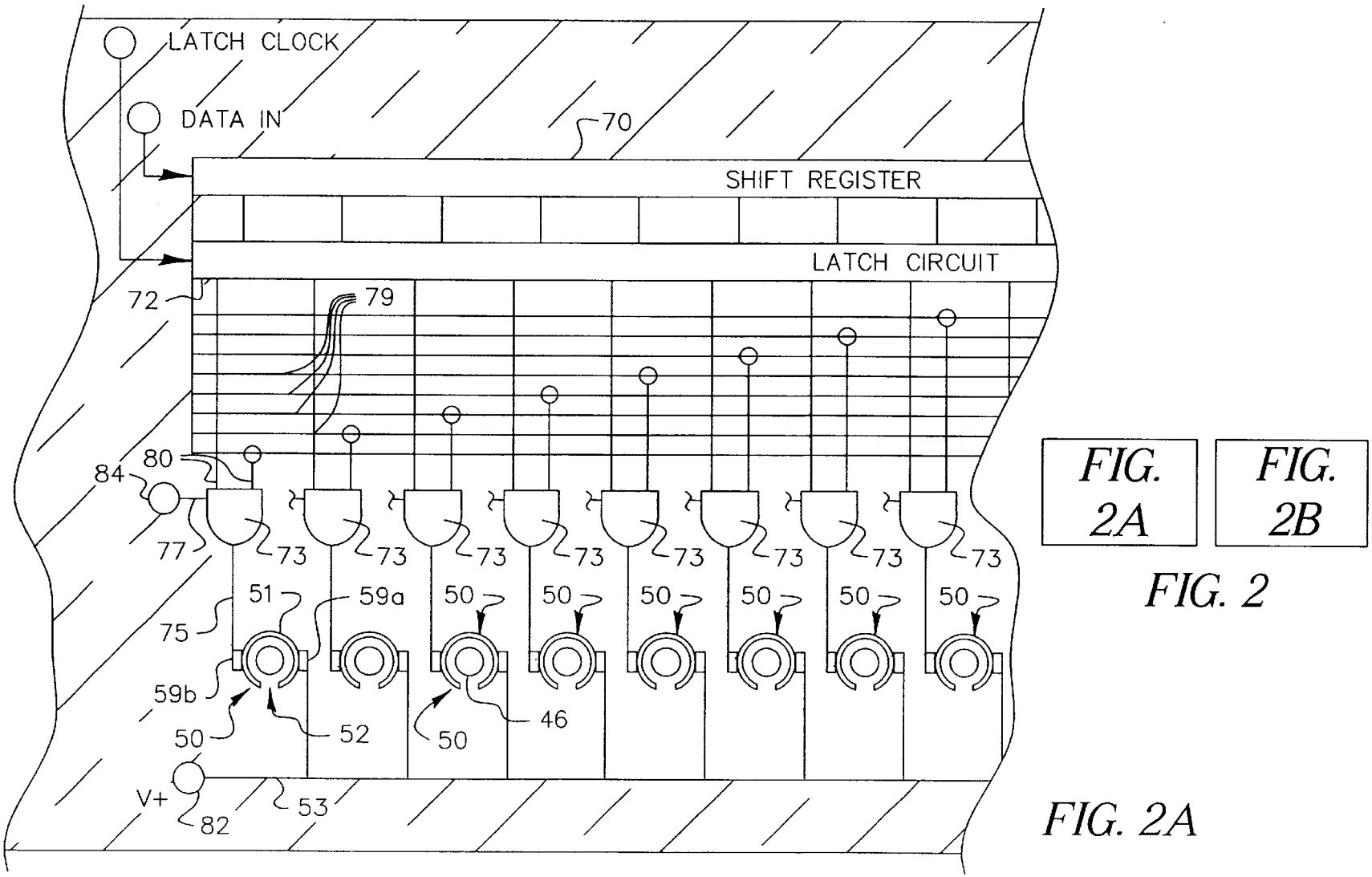
FIG. 2 is a partial, schematic plan view of the nozzle face of the printhead to the printing apparatus illustrated in FIG. 1, showing the nozzle outlets, heaters, and control circuit of the invention.
Figure 2B:
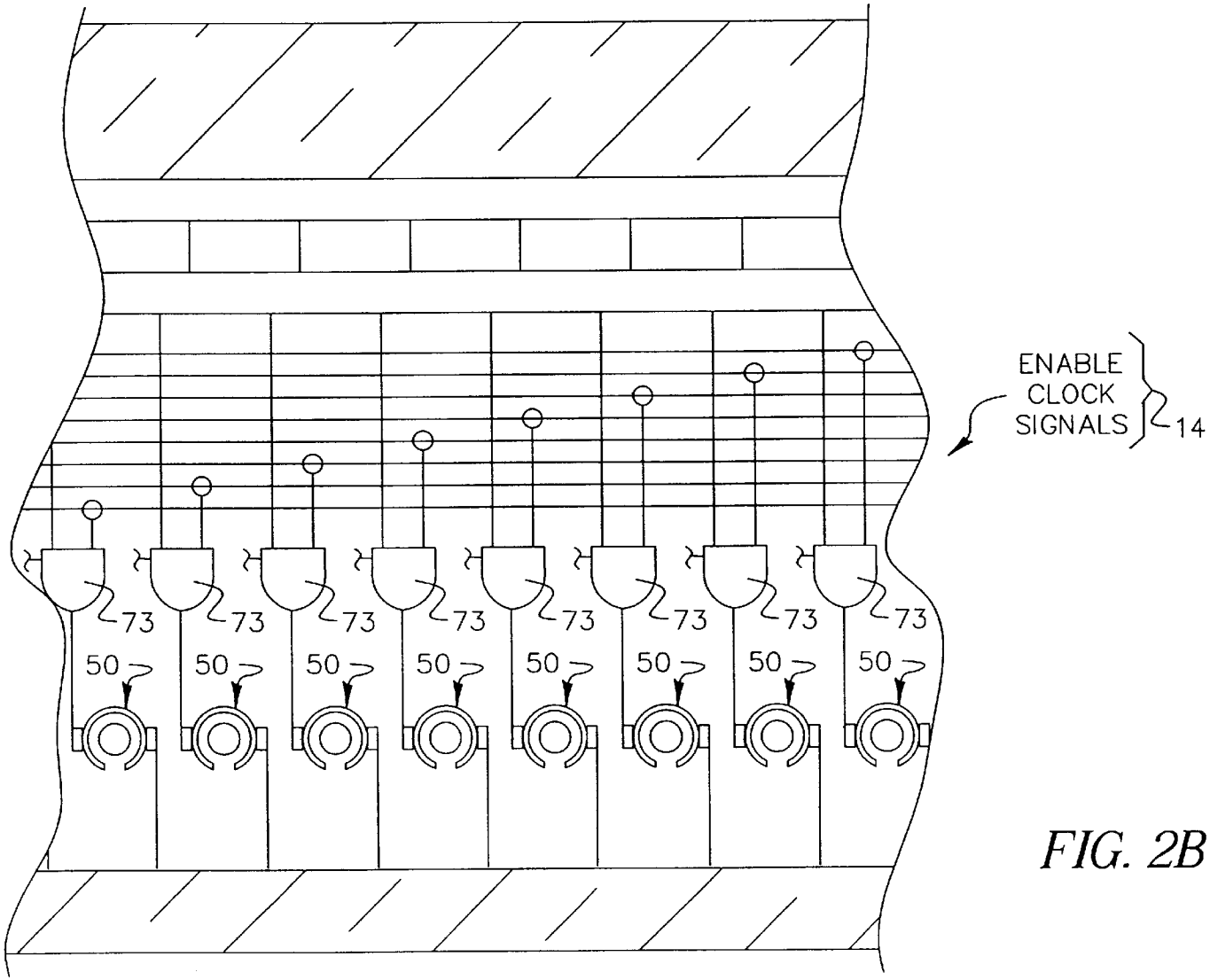

Referring to FIGS. 1 and 2, an asymmetric heat-type continuous inkjet printer system 1 includes an image source 10 such as a scanner or computer which provides raster image data, outline image data in the form of a page description language, or other forms of digital image data. This image data is converted to half-toned bitmap image data by an image processing circuit 12 which also stores the image data in memory. A heater control circuit 14 reads data from the image memory and applies electrical pulses to a heater 50 that applies heat to a nozzle 45 that is part of a printhead 16. These pulses are applied at an appropriate time, and to the appropriate nozzle 45, so that drops formed from a continuous inkjet stream will print spots on a recording medium 18 in the appropriate position designated by the data in the image memory.

Referring specifically to FIG. 1, recording medium 18 is moved relative to printhead 16 by a recording medium transport system 20 which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 28 under pressure. In the nonprinting state, continuous inkjet drop streams are unable to reach recording medium 18 due to an ink gutter 17 (also shown in FIG. 3) that blocks the stream and which may allow a portion of the ink to be recycled by an ink recycling unit 19. The ink recycling unit 19 reconditions the ink and feeds it back to reservoir 28. Such ink recycling units 19 are well known in the art. The ink pressure suitable for optimal operation will depend on a number of factors, including geometry and thermal properties of the nozzles 45 and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front nozzle face where a plurality of nozzles and heaters are situated. With printhead 16 fabricated from silicon, it is possible to integrate a heater control circuit 14 on the nozzle face of the printhead substrate.

Figure 3:
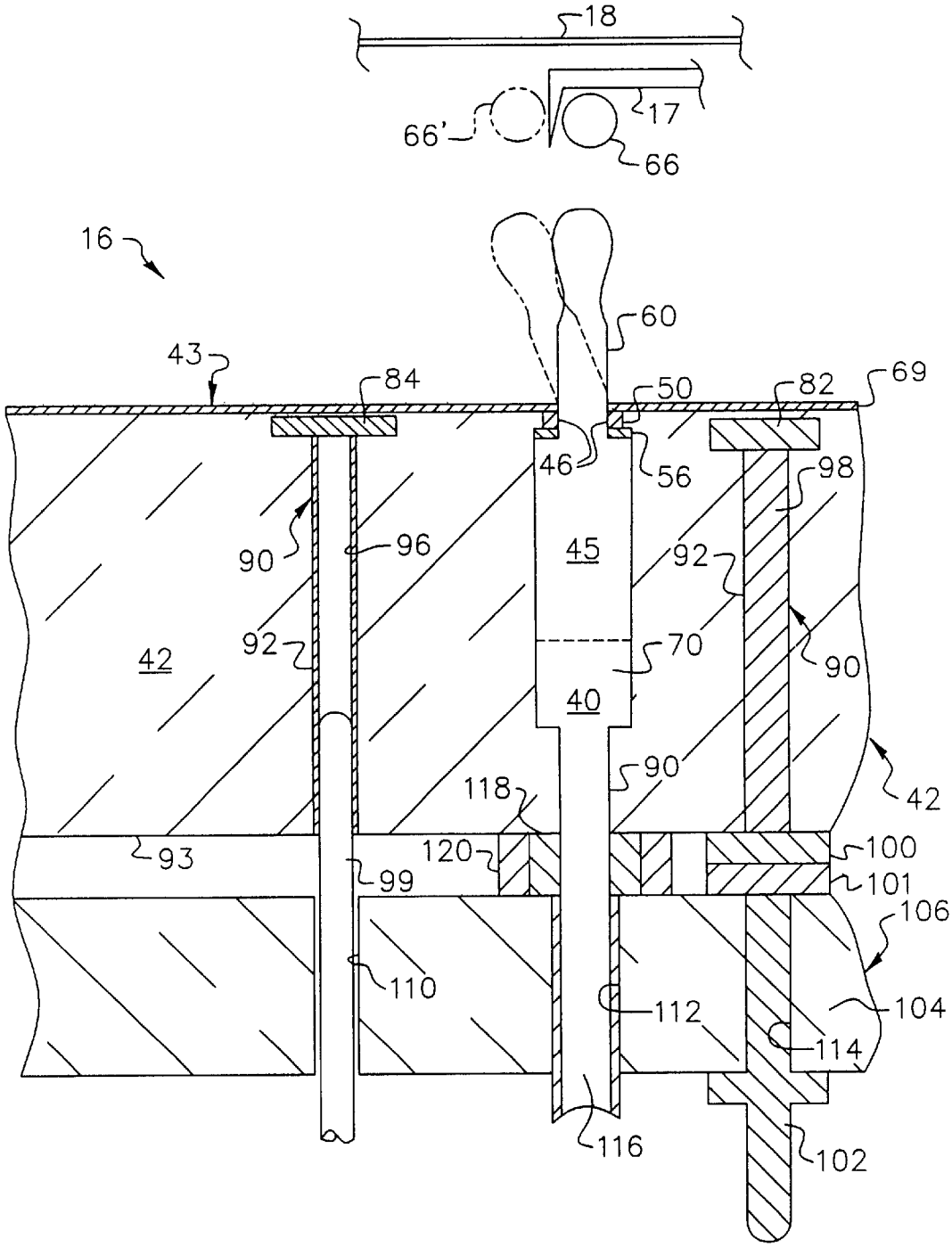
FIG. 3 is an illustrative, cross-sectional view of the printhead substrate of FIG. 2, showing the feedthroughs of the invention which accommodate power, image information and fluid conductors through the interior of the substrate.

FIG. 3 is a cross-sectional view of a tip of a nozzle 45 in operation. An array of such tips form the continuous inkjet printhead 16 of FIG. 1. An ink delivery channel 40, along with a plurality of nozzle outlets 46 are etched in a substrate 42, which is silicon in this example. Delivery channel 40 and nozzle outlets 46 may be formed by anisotropic wet etching of silicon, using a $p^+$ etch stop layer to form the nozzle outlets, or by an anisotropic plasma etch process. Ink 70 in delivery channel 40 is pressurized above atmospheric pressure, and forms a stream 60. At a distance above nozzle bore 46, stream 60 breaks into a plurality of drops 66 due to heat supplied by a heater 50.

With reference now to FIG. 2, each heater 50 includes an annular heating element 51 surrounding almost all of the nozzle outlet circumference. Each heating element 51 includes a break 52 that causes the current to flow from power conductor 53 only around the upper half of the element 51. In each heater 50, power connections 59*a*, 59*b* transmit electrical power pulses from the heater control circuit 14 to the heating element 51. As shown in FIG. 3, stream 60 is periodically deflected during a printing operation by the asymmetric application of heat generated on the right side of the nozzle outlet 46 by the heater element 51. This technology is distinct from that of electrostatic continuous stream deflection printers which rely upon deflection of charged drops previously separated from their respective streams. When stream 60 is undeflected, drops 66 are blocked from reaching recording medium 18 by a cut-off device such as ink gutter 17. However, when a heater 50 deflects stream 60 as shown in phantom, drops 66' (shown in phantom) are allowed to reach recording medium 18.

The heating element 51 of each heater 50 may be made of polysilicon doped at a level of about 30 ohms/square, although other resistive heater materials could be used. Heater 50 is separated from substrate 42 by thermal and electrical insulating layer 56 to minimize heat loss to the substrate. The nozzle bore 46 may be etched allowing the nozzle exit orifice to be defined by insulating layers 56. The nozzle face 43 can be coated with a hydro-phobizing layer 69 to prevent accidental spread of the ink across the front of the printhead.

With reference again to FIG. 2, heater control circuit 14 includes a shift register 70 for receiving digital data from the image processing circuit 12. Circuit 14 further includes a latch circuit 72 for regulating the flow of data bits to drive transistor 73, which in turn regulate the amount and timing of power pulses conducted through the various nozzle heaters 50. Each drive transistor 73 includes a source connector 75 connected to power conductor 53, and a drain connector 77 which is ultimately connected to a ground bar (not shown). Connectors 79 transmit clock signals that determine which of the heaters (in a particular group of eight such heaters) can be actuated and for how long. A gate connector 80 connects each of the drive transistors 73 to the latch circuit 72. While only 16 nozzles are illustrated in the portion of the nozzle face illustrated in FIG. 2, a typical printhead has between several hundred to several thousand such nozzles. The heaters that control the deflection of the droplets ejected through the various nozzles are not all connected to the same power conductor 53 due to the current limitations of the material forming such conductors 53. Instead, there are several such power conductors 53 in the printhead substrate 72, each of which is connected to some of the heaters 50. Each power conductor 53 (of which only one is shown) must be connected to a power source and a ground, respectively, through power and ground pads 82,84. Additionally, image and timing data must be continuously piped into the shift register 70 and latch circuit 72.

While such interconnections could be fabricated directly on the nozzle face 43 of the substrate 42, the inventors have observed that such a design would be accompanied by a number of shortcomings which have been previously discussed in the Background section. Accordingly, such interconnects are made via the substrate feedthroughs 90 illustrated in FIG. 3. Each feedthrough 90 includes a bore 92 that extends from just below the nozzle face 43 through the interior of the substrate 42 and out through a back face 93 of the substrate. Alternatively, the feedthrough 90 may include a bore 92 having a metallic coating 96 of aluminum or copper or some other electrically-conductive material, such as metal. Such a feedthrough may be used to connect ground pad 84 to a ground circuit via pin-type connector 99. The feedthrough 90 may include a bore 92 with a metal filling 98 of aluminum, copper, or some other electrically-conductive material. The higher conductivity of such a feedthrough renders it particularly useful as a power conductor that connects power pad 82 to pad 100 that ultimately engages the pad 101 of a pin-type connector 102 of a power source. Finally, the feedthrough 90 may include an ink conducting bore 112 for conducting pressurized ink to nozzle 45 via ink delivery channel 40.

The feedthroughs of the invention are compatible for use with a connector assembly 104 that plugs into the back of printhead substrate 42. Connector assembly 104 includes a ceramic base 106 having a plurality of through holes 110, 112, and 114 for accommodating the aforementioned pin connector 99, an ink needle 116, and the pin-type connector 102. The ink needle 116 is a fluid conductor that conducts ink into ink delivery channel 40 via feedthrough bore 112. An inner polyamide gasket 118 is provided on the front face of the ceramic base 106 of connector assembly 104, while an outer polyamide gasket 120 is provided on the back face of printhead substrate 42. When the connector assembly 104 is engaged against the back face of printhead substrate in the position illustrated in FIG. 3, pin connector 99 engages the metal coating 96 lining the bore 92 of feedthrough 90 while the inner and outer gaskets concentrically interfit to form a fluid coupling between ink needle 116 and ink delivery channel 40. Similarly, connection pads 100 and 101 engage to conduct power from pin 102 to the power pad 82. Hence the feedthroughs easily and effectively conduct electrical power and image information, and pressurized liquid ink to the nozzle face 43 of the printhead substrate 42 without the need for a dense, difficult-to-manufacture array of electrical and fluid conductors on the nozzle face 43.

While this invention has been described with respect to a continuous inkjet printing mechanisms, it is also applicable to printing mechanism in general, and in particular to drop-on-demand inkjet printers.

PARTS LIST

1. Printer system
10. Image source
12. Image processing circuit
14. Heater control circuit
16. Printhead
17. Ink gutter
18. Recording medium
19. Ink recycling unit
20. Transport system
22. Transport control system
24. Micro-controller
26. Inkjet pressure regulator
28. Ink reservoir
30. Ink channel device
40. Ink delivery channel
42. Substrate
43. Nozzle face
45. Nozzle
46. Nozzle outlets
50. Nozzle heater
51. Heating element
52. Break
53. Power conductor
56. Electrical insulating layer
59. Connector
60. Stream
61. Connector
64. Thin passivity film
66. Drops (undeflected)
69. Hydro-phobizing
70. Shift register
72. Latch circuit
73. Drive transistors
75. Source connector
77. Drain connector
78. Ground bar
79. Connectors
80. Gate connectors a,b
82. Power pad
84. Ground pad
92. Bore
93. Back face
96. Metal coating
98. Metal filling
99. Pin connector
100. Connection pad
101. Pad
102. Pin-type connector
103. Ink conducting bore
104. Connector assembly
106. Ceramic base
110. Through hole
112. Through hole
114. Through hole
116. Ink needle
118. Inner gasket
120. Outer gasket

What is claimed is:

1. An inkjet printhead for printing an image on a printing medium, comprising:

a silicon substrate having a series of nozzles formed therein, each nozzle terminating in a nozzle opening adjacent a first side of the substrate;

an electronically operated member associated with each respective nozzle for controlling droplets from the nozzle opening of the respective nozzle;

an electronic controller providing control to the electronically operated member associated with each nozzle, the electronic controller including a shift register for receiving digital data and a latch circuit for regulating the flow of data bits to the electronically operated member associated with each respective nozzle, the electronic controller including the shift register and the latch circuit being located within the silicon substrate adjacent the first side of the substrate;

conductive feedthrough connectors formed in the silicon substrate from a second side to a location adjacent the first side, the feedthrough connectors being electrically connected to the electronic controller; and a connector assembly connected to the second side of the substrate opposite the first side, the connector assembly having structure for providing ink to the series of nozzles and providing power and image data to respective conductive feedthrough connectors formed in the silicon substrate, the power and the image data being conducted by the conductive feedthrough connectors to the electronic controller.

2. The inkjet printhead of claim 1, wherein said feedthrough connectors comprise passageways extending through the substrate.

3. The inkjet printhead of clam 2, wherein the electronically operated member is a heater element that is formed in the substrate.

4. The inkjet printhead of claim 3, wherein a gasket material is located between the second side of the silicon substrate and the connector assembly to block ink from reaching the conductive feedthroughs.

5. The inkjet printhead of claim 1 and wherein the nozzle opening is formed in an insulating layer.

6. A method of operating an inkjet printhead for printing an image on a printing medium, the method comprising:

providing a silicon substrate having a series of nozzles formed therein, each nozzle terminating in a nozzle opening adjacent a first side of the substrate and an electronically operated member being associated with each nozzle, the silicon substrate including an electronic controller providing control to the electronically operated member associated with each nozzle, the electronic controller including a shift register for receiving digital data and a latch circuit for regulating the flow of data bits to the electronically operated member associated with each respective nozzle, the electronic controller including the shift register and the latch circuit being located within the silicon substrate adjacent the first side of the substrate;

enabling an electronically operated member associated with each respective nozzle selected for activation for controlling droplets from the nozzle opening of the respective nozzle;

providing a connector assembly connected to a second side of the substrate opposite the first side, the connector assembly providing ink to the series of nozzles and providing power and image data; and providing conductive feedthrough connectors formed in the silicon substrate from the second side to a location adjacent the first side, the feedthrough connectors conducting power and image data signals from the connector assembly to the electronic controller to control the electronically operated members.

7. The method of claim 6 and wherein the nozzle opening is formed in an insulating layer.

* * * * *